United States Patent [19]

Matsubara

[11] Patent Number: 4,993,337

[45] Date of Patent: Feb. 19, 1991

[54] SEWING MACHINE WITH AUTOMATIC THREAD CONTROL AND THREAD BREAKAGE DETECTING DEVICES

[75] Inventor: Kenji Matsubara, Aichi, Japan

[73] Assignee: Brother Kogyo Kabushiki Kaisha, Nagoya, Japan

[21] Appl. No.: 526,709

[22] Filed: May 22, 1990

[30] Foreign Application Priority Data

Jul. 5, 1989 [JP] Japan ..... 1-173756

[51] Int. Cl.[5] ..... D05B 69/36

[52] U.S. Cl. ..... 112/273; 112/302

[58] Field of Search ..... 112/273, 278, 302, 121.11, 112/277, 275

[56] References Cited

U.S. PATENT DOCUMENTS

| | | | |
|---|---|---|---|
| 4,244,310 | 1/1981 | Sasaki et al. | 112/126 |
| 4,269,131 | 5/1981 | Principe | 112/302 X |
| 4,408,554 | 10/1983 | Takiguchi et al. | 112/302 |
| 4,638,752 | 1/1987 | Hartwig | 112/458 |
| 4,691,654 | 9/1987 | Meier | 112/303 |
| 4,735,161 | 4/1988 | Brocklehurst | 112/273 |
| 4,766,827 | 8/1988 | Matsubara | 112/278 |
| 4,841,890 | 6/1989 | Tancs | 112/273 |

FOREIGN PATENT DOCUMENTS

| | | |
|---|---|---|
| 60-47869 | 3/1981 | Japan . |
| 59-9191 | 12/1981 | Japan . |
| 1-212595 | 8/1989 | Japan . |

*Primary Examiner*—Peter Nerbun

*Attorney, Agent, or Firm*—Oliff & Berridge

[57] ABSTRACT

A sewing machine includes a timing pulse generator, a thread feeding device, thread sensor, and microcomputer. The timing pulse generator generates a timing pulse when a main shaft is rotated by a predetermined rotational increment by a main motor. The thread feeding device feeds out a needle thread toward a needle. The thread sensor is disposed in a path of the needle thread between the thread feeding device and the needle, and generates a thread breakage signal when the needle thread is out of the path. The microcomputer drives the thread feeding device based on the timing signal generated by the timing pulse generator if the thread breakage signal is not generated by the thread sensor. The microcomputer counts the timing pulses after the thread breakage signal has been generated by the thread sensor. The microcomputer stops the main motor when a count value has reached first predetermined value. The microcomputer stops the thread feeding device when the count value has reached a second predetermined value which is smaller than the first predetermined value.

12 Claims, 4 Drawing Sheets

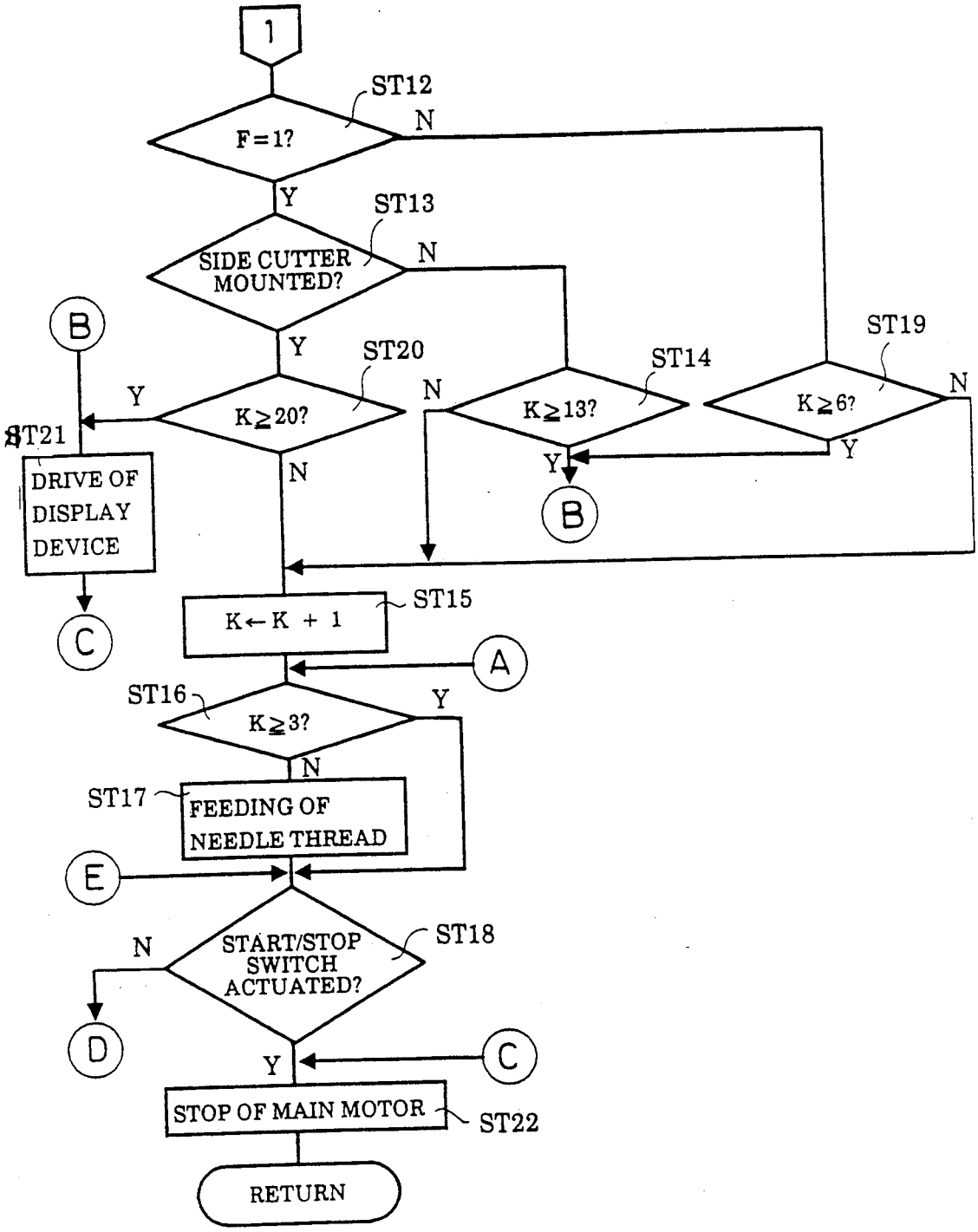
1
ST12
F=1?
N
Y
ST13
SIDE CUTTER MOUNTED?
N
B
Y
ST20
ST14
ST19
Y
K≥20?
N
K≥13?
K≥6?
N
ST21
DRIVE OF DISPLAY DEVICE
N
Y
Y
B
C
K←K + 1
ST15
A
ST16
K≥3?
Y
N
ST17
FEEDING OF NEEDLE THREAD
E
N
START/STOP SWITCH ACTUATED?
ST18
D
Y
C
STOP OF MAIN MOTOR
ST22
RETURN

SEWING MACHINE WITH AUTOMATIC THREAD CONTROL AND THREAD BREAKAGE DETECTING DEVICES

BACKGROUND OF THE INVENTION

1. Field of the Invention

The present invention relates to a sewing machine having an automatic needle thread control device and a thread breakage detecting device.

2. Description of the Related Art

A conventional sewing machine having an automatic needle thread control device is, for example, disclosed in Japanese Patent Publication No. 47869/1985. In this sewing machine, the feed amount of the needle thread necessary and sufficient for forming a stitch in a work fabric is calculated based on a needle swing amount and the feed pitch, and the thickness of the work fabric, and the thus calculated amount of the needle thread is fed out by means of rollers driven by a pulse motor.

A conventional sewing machine having a thread breakage detecting device is, for example, disclosed in Japanese Patent Publication No. 9191/1984. This type of sewing machine includes a thread detecting circuit for detecting movement of a thread take-up spring which is put into engagement with a needle thread by means of the thread take-up motion of a thread take-up lever, thereby generating a thread detection signal. In order to prevent a malfunction, it is determined that a thread breakage has occurred and a motor is caused to stop when the thread detection signal has not been generated even once while the main shaft of the sewing machine has made a predetermined number of rotations.

However, if such a thread breakage detecting device is attached to a sewing machine having the related art automatic needle thread control device, there arises the following problem. At the time when sewing has just been started, over casting is made, or a thin fabric is sewn with a slippery, thin thread, the needle thread between the automatic needle thread control device and the needle may become loose. Even when the needle thread is in such a loose state, the automatic needle thread control device feeds out the needle thread continuously and, hence, the needle thread does not recover from the loose state. As a result, even if the thread take-up lever makes the thread take-up motion, the needle thread will not engage the thread take-up spring while the main shaft makes a predetermined number of rotations. Thus, the thread detecting circuit detects no movement of the thread take-up spring, and therefore, such a problem arises that the thread breakage detecting device mistakes the loose thread for a thread breakage and thus stops the main motor.

SUMMARY OF THE INVENTION

A primary object of the present invention is to provide a sewing machine including an automatic needle thread control device and a thread breakage detecting device in which the thread breakage detecting device is adapted so as not to stop a main motor by mistaking a thread in a loose state for a thread in a broken state.

The above object can be achieved, according to the present invention, by a sewing machine which comprises:

thread feeding means for feeding out a needle thread toward a needle, thread breakage detecting means disposed in a path of the needle thread between the thread feeding means and the needle for detecting the needle thread along the path and generating a thread breakage signal when the needle thread is out of the path, and control means for stopping the thread feeding means based on the thread breakage signal generated by the thread breakage detecting means, said control means comprising discriminating means for discriminating between a thread breakage signal generated as a result of a loose needle thread and one generated as a result of a broken thread.

BRIEF DESCRIPTION OF THE DRAWINGS

A preferred embodiment of the present invention will be described in detail with reference to the following figures wherein.

DETAILED DESCRIPTION OF THE PREFERRED EMBODIMENTS

Figure 2:
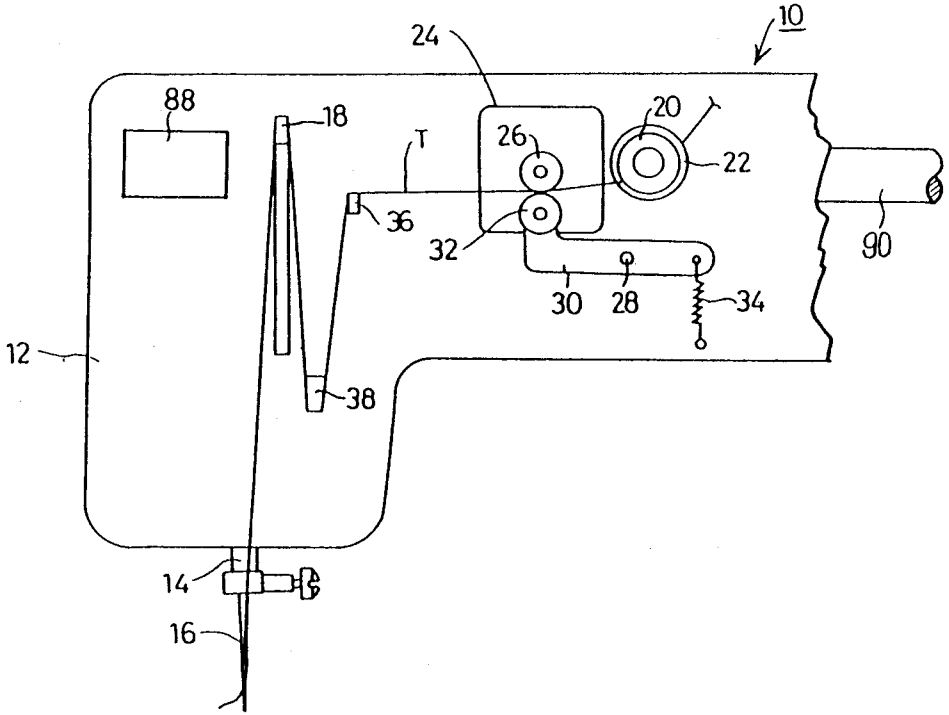
FIG. 2 is a front appearance view of the sewing machine.

FIG. 2 is a front view of an upper arm 10 of a sewing machine according to the present invention, in which a needle bar 14 is reciprocably and swingably supported on a head 12 of the upper arm 10. A needle 16 is attached to the lower end of the needle bar 14. The needle bar 14 is reciprocated in a vertical direction synchronized with the rotation of a main shaft 90 rotated by a later described main motor 86. Further, the needle bar 14 is swung in a lateral direction by a later described needle swinging pulse motor 62. In front of the head 12, there is provided a thread take-up lever 18 which makes vertical reciprocating movement in synchronism with the needle bar 14.

In the front of the upper arm 10, there are provided a pair of thread holding members 20 for holding a needle thread T therebetween and a holding solenoid 22 for enabling the thread holding members 20 to hold the needle thread T therebetween. In the front of the upper arm 10, there is further provided a thread feeding pulse motor 24 for feeding out the needle thread T, and a driving roller 26 is fixed to the output shaft of the thread feeding pulse motor 24. In front of the upper arm 10, there is also provided a turning arm 30 for turning round a shaft 28, and at one end of the turning arm 30, there is provided a driven roller 32. The driven roller 32 is normally pressed against the driving roller 26 by urging force of a spring 34 arranged between the other end of the turning arm 30 and the upper arm 10. The needle thread T is fed from a needle thread spool (not shown) to the needle 16 by way of the pair of thread holding members 20, the pair of rollers 26 and 32, a thread guard member 36, a thread take-up spring device 38 and the thread take-up lever 18.

Figure 3:
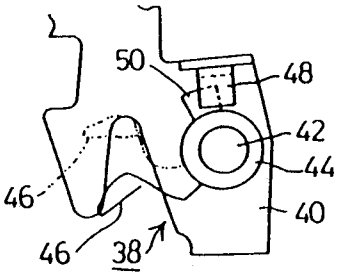
FIG. 3 is a side view of a thread take-up spring device.

FIG. 3 is an enlarged side view of the thread take-up spring device 38.

The thread take-up spring device 38 comprises a mounting board 40 fixed to the upper arm 10, a spring holder 44 rotatably mounted on the mounting board 40 around a shaft 42, and a thread take-up spring 46 attached to the spring holder 44. The spring holder 44 is urged by a spring (not shown) so that the thread take-up spring 46 is normally biased from the position drawn by the imaginary line toward the position drawn by a solid line, and when the needle thread T is taken up by the thread take-up lever 18, the thread take-up spring 46 is moved to the position of the imaginary line by the engagement with the needle thread T.

On the mounting board 40, there is mounted a known thread detecting sensor 48 comprising a light emitting diode and a photodiode, and it is adapted such that a shutter 50 attached to the spring holder 44 traverses the path between the light emitting diode and the photodiode in association with the thread take-up motion of the thread take-up lever 18.

Figure 1:
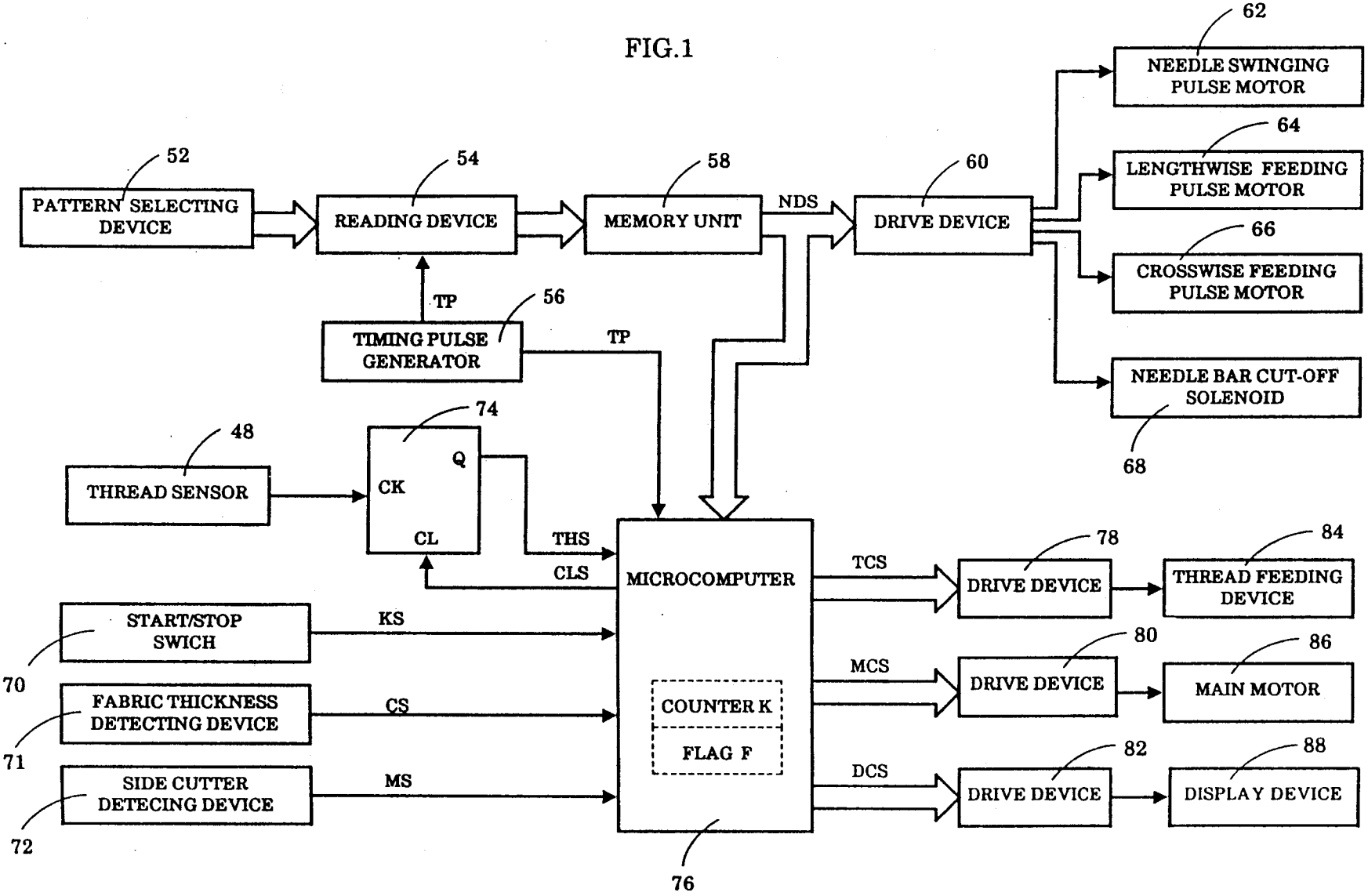
FIG. 1 is a block diagram showing an electric arrangement in a sewing machine according to the present invention.

An electric arrangement in the present embodiment will be described below with reference to FIG. 1.

A pattern selecting device 52 is adapted to generate a pattern code signal corresponding to a selected pattern. A timing pulse generator 56 is adapted to generate a timing pulse TP at the time when the rotational angle of the main shaft is at 152° (the position where the needle 16 is at the highest position is set to be 0°). A reading device 54 is adapted to update an address signal corresponding to the pattern code signal from the pattern selecting device 52 whenever supplied with the timing pulse TP from the timing pulse generator 56 and to supply the updated address signal to a memory unit 58. The memory unit 58 is so constituted as to store stitch data signals NDS of the patterns capable of being stitched by the sewing machine and to generate the stitch data signal NDS according to the address signal supplied thereto. A drive device 60 is adapted to drive, according to the stitch data signal NDS, a needle swinging pulse motor 62, a lengthwise feeding pulse motor 64, a crosswise feeding pulse motor 66, and a needle bar cut-off solenoid 68, and a stitch pattern is formed by action of the pulse motors and solenoid. The mechanical arrangements of the needle swinging device, the lengthwise and crosswise feeding devices, and the needle bar cut-off device driven by the pulse motors and the solenoid may be of the types described in the specifications and accompanying drawings of U.S. Pat. Nos. 4,691,654 and 4,638,752.

A start/stop switch 70 is actuated to control drive of the main motor 86 and generates an operating signal KS according to the actuation. A side cutter detecting device 72 generates a side cutter detection signal MS when a side cutter such as described in the specification and the accompanying drawings of U.S. Pat. No. 4,244,310 is mounted on the sewing machine.

The thread sensor 48 detects the movement of the thread take-up spring 46 in association with the thread take-up motion of the thread take-up lever 18, and supplies a high level detecting signal to a flip-flop 74. The flip-flop 74 generates, in response to the rising of the detection signal generated by the thread sensor 48, a high level thread detection signal THS until a later described clear signal CLS is inputted thereto. Accordingly, a low level thread detection signal THS corresponds to a thread breakage signal.

A fabric thickness detecting device 71 generates a fabric thickness signal CS corresponding to the thickness of the work fabric. Since the fabric thickness detecting device 71 is equivalent to the device disclosed in the specification and the accompanying drawings of U.S. Pat. No. 4,408,554, detailed description thereof will be omitted.

Figure 4:
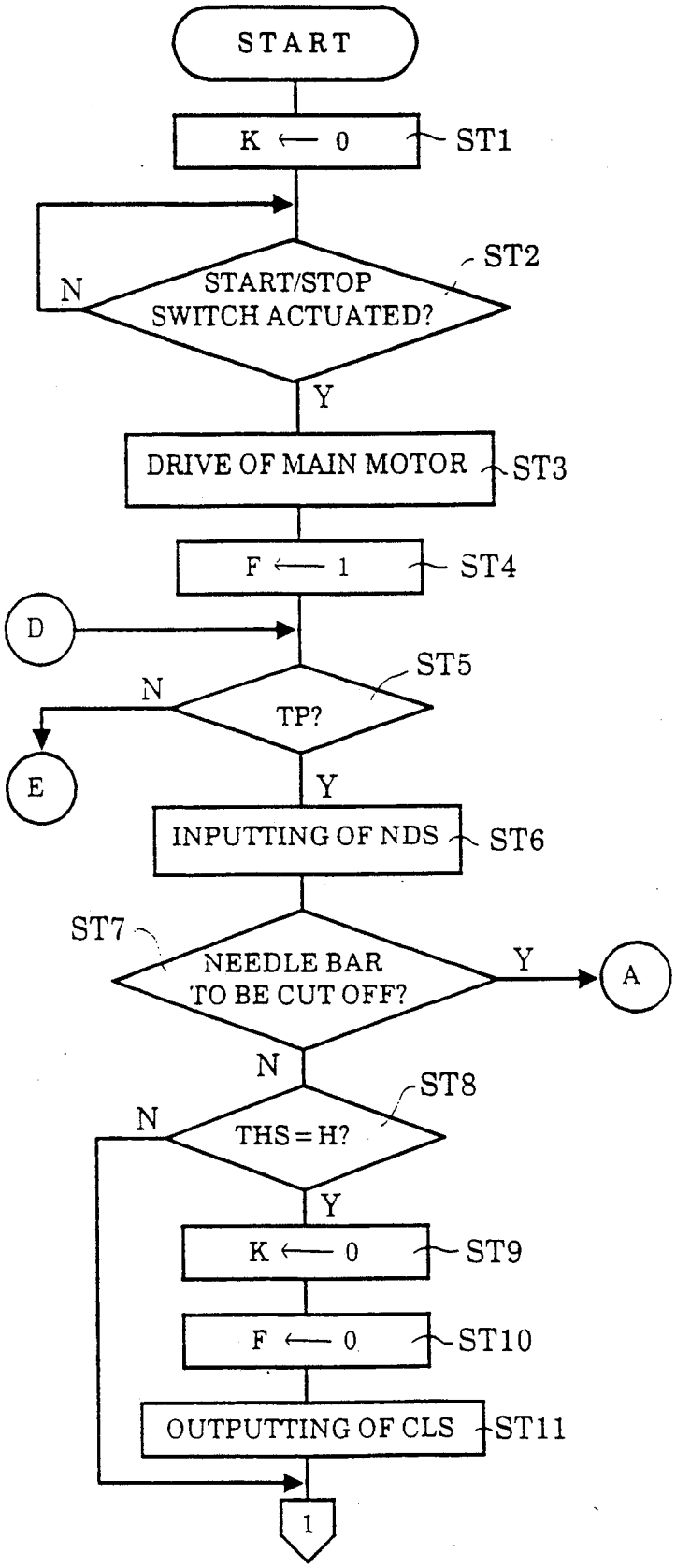
FIG. 4(*a*) and FIG. 4(*b*) are flow charts showing operations of a control unit.

A microcomputer 76, having counter K and flag F receives various signals and generates a thread control signal TCS, a motor control signal MCS, and a display control signal DCS according to a flow chart shown in FIG. 4. Drive devices 78, 80 and 82 drive a thread feeding device 84, the sewing machine motor 86, and a display device 88 in response to the supplied signals TCS, MCS and DCS.

The thread feeding device 84 comprises the above described thread holding solenoid 22 and thread feeding pulse motor 24. The thread feeding device 84 supplies the needle 16 with the needle thread T of the amount necessary and sufficient for forming the stitches in the work fabric and stops the supply of the needle thread T while the needle thread T is taken up by the thread take-up lever 18. The thread feeding device 84 may be of the types disclosed in U.S. Pat. Nos. 4,766,827 and 4,408,554.

The display device 88 includes a liquid crystal display and a speaker provided on the upper arm 10 of the sewing machine and displays various kinds of information.

Operations of the sewing machine constituted as described above will be described with reference to the flow charts of FIG. 4(*a*) and FIG. 4(*b*).

First, when power is turned on by an operator, the microcomputer 76 makes initial setting and sets the value of a counter K at "0" in step ST1. Hereinafter, the process steps of FIGS. 4(*a*) and 4(*b*) will be referred to with the abbreviation "ST". Then, the needle thread T is set in the sewing machine through the thread holding members 20, both rollers 26 and 32, the thread guard 36, the thread take-up spring device 38, the thread take-up lever 18, and the needle 16 by the operator. The needle thread T is loosest when it is first set in the sewing machine as described above. Then, if the operator selects a desired pattern by means of the pattern selecting device 52 and actuates the start/stop switch 70, the microcomputer 76 judges whether or not the start/stop switch 70 has been actuated for starting the sewing machine in ST2. If the start/stop switch 70 has been actuated, the microcomputer 76 supplies the drive device 80 with the motor control signal MCS for driving the main motor 86 in ST3, whereupon the drive device 80 starts to drive the main motor 86.

The microcomputer 76, after setting a flag F to "1" in ST4, judges whether or not a timing pulse TP has been generated as a result of a certain rotation of the main shaft 90 driven by the main motor 86 in ST5. If the timing pulse TP has been generated, the microcomputer 76 receives the stitch data signal NDS outputted from the memory unit 58 in ST6. The stitch data signal NDS includes data of swinging amount of the needle 16, data of lengthwise and crosswise feeding amounts by feed dogs, and data as to whether or not the coupling between the needle bar 14 and the main shaft 90 is to be cut off. The microcomputer 76 judges whether or not the needle bar 14 is to be cut off according to the input stitch data signal NDS in ST7. If the needle bar 14 is not to be cut off, microcomputer 76 judges whether or not the thread detecting signal THS is at a high level in ST8. Since the needle thread T is loose at the start of sewing a pattern, the thread take-up spring 46 is not moved by the needle thread T even if the thread take-up lever 18 makes the thread take-up motion and, hence, the flip-flop 74 is in the state outputting the thread detection signal THS at a low level.

Therefore, the microcomputer 76 judges that the thread detection signal THS is not at high level in ST8 and, without making operations in ST9, ST10 and ST11, judges whether or not the flag F is "1" or not in ST12. Since the flag F was set to "1" in ST4, the microcomputer 76 judges whether or not the side cutter is mounted on the sewing machine according to the side cutter signal MS in ST13. When the side cutter is not mounted, the microcomputer 76 judges whether or not the value of the counter K is "13" or over in ST14. Since the value of the counter K was set at "0" in ST1, the microcomputer 76 adds "1" to the value of the counter K, thereby making it "1", in ST15. Then, the microcomputer 76 judges that the value of the counter K is not "3" or over in ST16, and supplies the thread control signal TCS to the drive device 78 for feeding out the needle thread T of the amount necessary and sufficient for forming the stitch based on the stitch data signal NDS and the fabric thickness data CS in ST17. The drive device 78 drives the thread feeding device 84 according to the thread control signal TCS so that the needle thread T is fed out toward the needle 16. The microcomputer 76 determines whether or not the start/stop switch 70 has been actuated for stopping the sewing machine in ST18, and if the start/stop switch 70 has not been actuated, it cyclically performs the operations in ST5 through ST8 and in ST12 through ST18, increasing the value of the counter K by "1" each cycle. When the value of the counter K has reached "3", the microcomputer 76 judges that the value of the counter K has reached "3" in ST16 and performs the operation in ST18 without making operation in ST17. Therefore, at the start of sewing a pattern, the needle thread T is fed out by the thread feeding device 84 until the value of the counter K reaches "3", and thereafter, stitches are formed in the work fabric without the needle thread T being fed out. Then, when the loose needle thread T is consumed and the thread take-up spring 46 is moved by means of the thread take-up motion of the thread take-up lever 18, whereby the detection signal is generated by the thread detecting sensor 48 before the value of the counter K reaches "13", the flip-flop 74, in response to the thus generated detection signal, generates the thread detecting signal THS at a high level. When the microcomputer 76 judges that the thread detection signal THS is at a high level in ST8, it sets the value of the counter K at "0" in ST9, sets the flag F at "0" in ST10, and supplies the clear signal CLS to the flip-flop 74 in ST11. Upon receipt of this clear signal CLS, the flip-flop 74 generates a thread detecting signal THS at a low level. Then, the microcomputer 76 judges that the flag F is not "1" in ST12, and then, it determines that the value of the counter K is not "6" or over ST19, and thereafter, it performs the operations in ST15 and the steps that follow.

Since the needle thread T becomes loose especially when the side cutter is mounted on the sewing machine and over casting is started, the microcomputer 76 judges that the side cutter is mounted in ST13 and performs the operations in ST15 and the steps that follow until the value of the counter K reaches "20" in ST20.

Now, the case where the needle thread T has been broken will be described. The microcomputer 76 judges that the needle thread T is broken when it has found that the value of the counter K is "13" at the start of sewing a pattern in ST14, when it has found that the value of the counter K is "20" at the start of over casting with the side cutter being mounted in ST20, and when it has found that the value of the counter K is "6" in the case of normal sewing in ST19, and then it proceeds to ST21. In ST21, the microcomputer 76 supplies the drive device 82 with a display control signal DCS indicative of the state of thread breakage, and then, supplies the drive device 80 with a motor control signal MCS for stopping the main motor 86 in ST22. The drive device 82 causes the display device 88 to display the thread breakage state based on the display control signal DCS and the drive device 82 causes the main motor 86 to stop based on the motor control signal MCS.

When the microcomputer 76 has found that the needle bar 14 has been cut off from the main shaft 90 in ST7, the microcomputer 76 performs the operations in ST16 and the steps that follow without increasing the value of the counter K. Operations in such a manner are performed because, when the needle bar 14 is cut off, no stitch is formed whereby the thread take-up spring 46 is not moved, and therefore, the detecting signal is not supplied from the thread detecting sensor 48 even when the needle thread T is not broken.

While the present invention has been described in terms of specific embodiments thereof, numerous modifications and variations within the scope and spirit of the invention will be apparent to those of ordinary skill upon reading this disclosure. Accordingly, the invention is limited solely by the scope of the appended claims.

What is claimed is:

1. A sewing machine comprising:

thread feeding means for feeding out a needle thread toward a needle;

thread breakage detecting means disposed in a path of the needle thread between said thread feeding means and the needle for detecting the needle thread along the path and generating a thread breakage signal when the needle thread is out of the path; and control means for stopping said thread feeding means based on the thread breakage signal generated by said thread breakage detecting means, said control means comprising discriminating means for discriminating between a thread breakage signal generated as a result of a loose needle thread and one generated as a result of a broken thread.

2. The sewing machine according to claim 1, wherein said discriminating means identifies a thread breakage signal generated as a result of a broken thread based upon a time duration of said thread breakage signal.

3. The sewing machine according to claim 2, wherein said control means includes a count means and said time duration is measured by a count value of said count means which is reset each time the thread breakage signal is discontinued.

4. The sewing machine according to claim 3, wherein the count value indicating a broken rather than loose thread is different depending upon whether (a) sewing has just begun and a side cutter is not being used; (b) sewing has just begun and a side cutter is being used; or (c) sewing has continued for a predetermined duration.

5. The sewing machine according to claim 1, wherein said control means stops a main motor of said sewing machine when said discriminating means determines that the thread breakage signal is generated as a result of a broken thread.

6. A sewing machine comprising:

position detecting means for detecting a predetermined rotational angular position of a main shaft driven by a main motor and generating a position signal;

thread feeding means for feeding out a needle thread toward a needle;

first control means for driving said thread feeding means based on the position signal generated by said position detecting means;

thread breakage detecting means disposed in a path of the needle thread between said thread feeding means and the needle for detecting the needle thread along the path and generating a thread breakage signal when the needle thread is out of the path;

count means for counting the position signals generated during the time the thread breakage signal is generated by said thread breakage detecting means;

second control means for stopping the main motor when a count value of said count means has reached first predetermined value; and third control means for stopping said thread feeding means when the count value of said count means has reached a second predetermined value which is smaller than the first predetermined value.

7. The sewing machine according to claim 6, wherein the first predetermined value comprises a normal value applying to normal sewing and an initial value applying to a start of sewing, the normal value being smaller than the initial value.

8. The sewing machine according to claim 7, further comprising:

a side cutter detecting means for detecting a side cutter mounted on the sewing machine and generating side cutter detecting signal, and wherein the initial value comprises a first initial value applying when the side cutter detecting signal is not generated by said side cutter detecting means and a second initial value applying when the side cutter detecting signal is generated by said side cutter detecting means, the first initial value being smaller than the second initial value.

9. The sewing machine according to claim 6, further comprising:

display means for displaying information concerning breakage of the needle thread; and fourth control means for driving said display means when the count value of said count means has reached the first predetermined value.

10. A sewing machine comprising:

a main motor for driving at least a needle bar of said sewing machine;

thread feeding means including a second drive motor for feeding out a needle thread toward a needle;

thread breakage detecting means disposed in a path of the needle thread between said thread feeding means and the needle for detecting the needle thread along the path and generating a thread breakage signal when the needle thread is out of the path; and control means for stopping said second drive motor of said thread feeding means while permitting said main motor to operate based on the thread breakage signal generated by said thread breakage detecting means.

11. The sewing machine according to claim 10, wherein said control means permits said main motor to operate for a predetermined time period after stopping said second drive motor.

12. The sewing machine according to claim 11, wherein said control means stops said main motor after said predetermined time period unless said thread breakage signal is no longer generated by said thread breakage detecting means.

* * * * *